US007166014B2

(12) United States Patent
Benner et al.

(10) Patent No.: US 7,166,014 B2
(45) Date of Patent: Jan. 23, 2007

(54) CHEMICAL MECHANICAL PLANARIZATION PROCESS CONTROL UTILIZING IN-SITU CONDITIONING PROCESS

(75) Inventors: Stephen J. Benner, Lansdale, PA (US); Yuzhuo Li, Norwood, NY (US)

(73) Assignee: TBW Industries Inc., Furlong, PA (US)

( * ) Notice: Subject to any disclaimer, the term of this patent is extended or adjusted under 35 U.S.C. 154(b) by 0 days.

(21) Appl. No.: 11/042,999

(22) Filed: Jan. 25, 2005

(65) Prior Publication Data

US 2005/0164606 A1 Jul. 28, 2005

Related U.S. Application Data

(60) Provisional application No. 60/539,163, filed on Jan. 26, 2004.

(51) Int. Cl.

| | |
|---|---|
| ***B24B 49/00*** | (2006.01) |
| ***B24B 51/00*** | (2006.01) |
| ***B24B 7/00*** | (2006.01) |
| ***H01L 21/302*** | (2006.01) |

(52) U.S. Cl. ..... 451/5; 451/8; 451/41; 451/56; 451/287; 438/690

(58) Field of Classification Search ..... 451/41, 451/5, 8, 6, 56, 60, 285–289; 438/690
See application file for complete search history.

(56) References Cited

U.S. PATENT DOCUMENTS

| | | | | |
|---|---|---|---|---|
| 3,987,808 | A * | 10/1976 | Carbonell et al. | 137/3 |
| 5,885,137 | A * | 3/1999 | Ploessl | 451/56 |
| 6,190,236 | B1 | 2/2001 | Drill | |
| 6,217,416 | B1 * | 4/2001 | Kaufman et al. | 451/41 |
| 6,508,697 | B1 | 1/2003 | Benner et al. | |
| 6,509,269 | B1 * | 1/2003 | Sun et al. | 438/690 |
| 6,569,690 | B1 | 5/2003 | Houge | |
| 6,572,731 | B1 * | 6/2003 | Roy | 156/345.12 |
| 6,633,379 | B1 * | 10/2003 | Roesner et al. | 356/301 |
| 6,762,832 | B1 | 7/2004 | Fisher et al. | |
| 6,776,871 | B1 | 8/2004 | Ararwal | |
| 6,856,394 | B1 * | 2/2005 | Cheng | 356/436 |
| 2004/0134515 | A1 * | 7/2004 | Castrucci | 134/2 |
| 2004/0214508 | A1 * | 10/2004 | Gotkis | 451/5 |
| 2004/0218173 | A1 | 11/2004 | Fisher et al. | |
| 2005/0153632 | A1 * | 7/2005 | Moore et al. | 451/8 |

* cited by examiner

*Primary Examiner*—M. Rachuba
(74) *Attorney, Agent, or Firm*—Wendy W. Koba

(57) ABSTRACT

A system and method for providing process control in a CMP system utilizes a vacuum-assisted arrangement for conditioning a wafer polishing pad so that the effluent (i.e., wafer debris, polishing slurry, chemical or other by-products) from the conditioning process is diverted from the waste stream and instead introduced into an analysis module for further processing. The analysis module functions to determine at least one parameter within the effluent and generate a process control signal based upon the analysis. The process control signal is then fed back to the planarization process to allow for the control of various parameters such as polishing slurry composition, temperature, flow rate, etc. The process control signal can also be used to control the conditioning process and/or determining the endpoint of the planarization process itself.

14 Claims, 3 Drawing Sheets

CHEMICAL MECHANICAL PLANARIZATION PROCESS CONTROL UTILIZING IN-SITU CONDITIONING PROCESS

CROSS-REFERENCE TO RELATED APPLICATION

This application claims the benefit of U.S. Provisional Application No. 60/539,163, filed Jan. 26, 2004.

TECHNICAL FIELD

The present invention relates to chemical mechanical planarization (CMP) and, more particularly, to the analysis of effluent from a CMP conditioning process for controlling the planarization process and providing endpoint detection.

BACKGROUND OF THE INVENTION

The electronics industry continues to rely upon advances in semiconductor manufacturing technology to realize higher-functioning devices while improving their reliability and cost. For many applications, the manufacture of such devices is complex, and maintaining cost-effective manufacturing processes while concurrently maintaining or improving product quality is difficult to accomplish. As the requirements for device performance and cost become more demanding, realizing a successful manufacturing process becomes more difficult.

Indeed, as the level of circuit integration increases, more layers are required to be formed upon the silicon starting wafer. The use of multiple layers results in problems associated with surface non-planarity, impacting both yield and chip performance. Indeed, one of the most crucial processing steps today is related to restoring a planar surface to the wafer between the formation of each layer, as well as "planarizing/polishing" the final wafer structure before it is diced into separate components. Extreme care must be taken during this planarization process, since a significant amount of time and money has been invested in transforming the wafer from a uniform silicon slab into a complicated electronic circuit by the time the final planarization process is performed.

Within the past decade or so, a process known as chemical mechanical planarization (CMP) has evolved as a preferred technique for planarizing a wafer surface. CMP involves the use of a polishing pad affixed to a polishing table, with a separate holder used to present the silicon wafer "face down" against the rotating polishing pad. A polishing slurry containing both abrading particulates and chemical additives is dispensed onto the surface of the polishing pad and used to carefully remove irregularities from the wafer surface. The abrading particulates provide for the "mechanical" aspect of the planarization process, while specific chemical additives are used to selectively oxidize or etch the non-planar material from the wafer surface. When the surface layer of the wafer is, for example, a dielectric material, potassium hydroxide or another base oxidizer may be used as the chemical additive. When the surface layer of the wafer comprises copper (as discussed further below, metal CMP is becoming more prevalent), the chemical additive may comprise hydrogen peroxide. In any case, the combination of the abrading particulates and the chemical additive(s) in the polishing slurry results in planarizing the wafer surface as it moves against the polishing pad.

One area of concern with the CMP process is the changes that occur to the polishing pad over time. That is, if the polishing pad is not cleaned on a regular basis, the surface of the pad begins to accumulate spent polishing slurry abrasive particulates, removed wafer material and chemical or other by-products of the polishing process. This deposited debris, in combination with polishing heat effects, causes the polishing pad to become matted down and wear unevenly (often referred to in the art as the "glazing effect"). Thus, it becomes necessary to restore the polishing pad surface to a state suitable for continued polishing.

"Pad conditioning" or "pad dressing" is a process known in the art that is used to restore the surface of the polishing pad and remove the glazing by dislodging particulates and spent polishing slurry from the pad. Pad conditioning also planarizes the pad by selectively removing pad material, and roughens the surface of the polishing pad. Pad conditioning may be performed "ex-situ" (i.e., by conditioning the polishing pad between wafer polishing cycles), or "in-situ" (i.e., by conditioning the polishing pad currently with, or during, a wafer polishing cycle). In a typical prior art "in-situ" pad conditioning process, a fixed abrasive that functions to remove a small amount of pad material and debris is applied to the pad surface, thus creating new asperities for allowing the polishing slurry to flow freely. The removed pad material and debris thereafter combine with the slurry flow stream from the polishing process and are carried away from the pad and the wafer being polished by normal slurry transport mechanics. Ultimately, these materials are flushed at the end of the polishing cycle with rinse water, and collected in the central drain of the polisher.

During a conventional CMP process, the removal rate of the surface material will change as a function of various factors including, but not limited to, applied pressure, rotational speed, flow rate of the polishing slurry, temperature of the polishing slurry, size and/or concentration of particulates in the polishing slurry and chemistry of the polishing slurry, as well as the amount of material remaining on the surface of the wafer to be planarized. At times, it is difficult to control the planarization process so that "overpolishing" (referred to as "dishing") or "underpolishing" (not clearing the entire film) does not occur. One prior art arrangement utilizes a multiple number of polishing stations within the CMP apparatus to attempt to control the planarization process. In particular, a first station may be used to perform a "rough" planarization to remove the bulk amount of the unwanted material, perhaps depending on a specific time period to determine when to stop the rough planarization process. A second station may then be used to perform a "finer" planarization step, perhaps including some means of "endpoint detection" to determine when the appropriate amount of unwanted material has been removed. Lastly, a third station may be used as a "buffing" station to apply a final polishing to the wafer. Each of these stations can then be separately controlled to provide the greatest degree of care for the overall process. When performing metal CMP, different polishing stations may be used to selectively remove different types of material from the wafer surface. For example, a first station may be used to remove the overburden copper, a second station to remove the barrier metal (e.g., tantalum), and a third station to achieve final planarity and protect the copper from corrosion.

Since various other parameters associated with the polishing slurries, polishing pad and wafer will affect each of these stations, it remains difficult to accurately and efficiently control the planarization process in any type of multi-step CMP process.

SUMMARY OF THE INVENTION

The various needs of the prior art are addressed by the present invention, which relates to a conditioning process for CMP wafer polishing that utilizes a portion of the debris or effluent removed during conditioning to control the various steps in the planarization operation (including, but not limited to, endpoint detection).

In accordance with the present invention, a CMP system includes an abrasive conditioning disk with an apertured/open structure that is used to dislodge debris from the polishing pad surface and evacuate the dislodged debris through the apertured surface by applying a vacuum force through the conditioning disk. The debris, as it is being created during the polishing process, is therefore pulled through the conditioning disk and evacuated into an analysis system. Various flushing agents (either ultra-pure water (UPW) or a liquid with a particular chemistry) may be introduced through the conditioning apparatus onto the polishing pad surface to assist in the debris removal process. The evacuated debris (also referred to hereinafter as "effluent") is then directed into an analyzer that can determine the various materials present in the effluent (or specific properties of these materials), perhaps in terms of the concentration of each component. This information is then fed back to the polishing slurry delivery apparatus, the polisher mechanical controller and/or the conditioning system, where it is used to control the planarization process.

In one instance, the information fed back to the planarization process may be used to modify the material removal rate as a function of the measured concentration of various materials analyzed in the effluent. For example, if the particular concentration of conditioning process effluent is lower than desired, the control signal fed back to the polishing slurry delivery apparatus may be used to adjust the flow rate of the polishing slurry, the temperature of the polishing slurry, the concentration/size of the abrasive particulate, etc. Indeed, there are a significant number of planarization process and/or conditioning process parameter variations that may be utilized to provide CMP process control in accordance with the present invention.

In another instance, the information fed back to the planarization process may be used to determine the endpoint of the planarization process itself. For example, when used with copper CMP, the concentration of copper ions in the conditioning effluent will rapidly decrease upon onset of the "endpoint". Thus, by monitoring the copper concentration (or conductivity of the effluent), the planarization process may be stopped when the predetermined "endpoint concentration" or other appropriate parameter is obtained.

Various arrangements may be used to perform the analysis on the evacuated conditioning effluent. For example, the conductivity of the effluent may be measured and used as a feedback signal. The pH of the conditioning effluent may be measured and used in an alternative arrangement. In a more sophisticated system, Raman spectroscopy may be used to analyze the concentration of various components within the effluent. An electrochemical cell may alternatively be used to determine the ion concentration of a metal as it is being removed during a metal CMP process. The particular method of effluent analysis is not of concern, as long as an understanding of certain characteristics of various effluent components can be elicited and used by the CMP system to control the planarization process.

Indeed, other and further aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
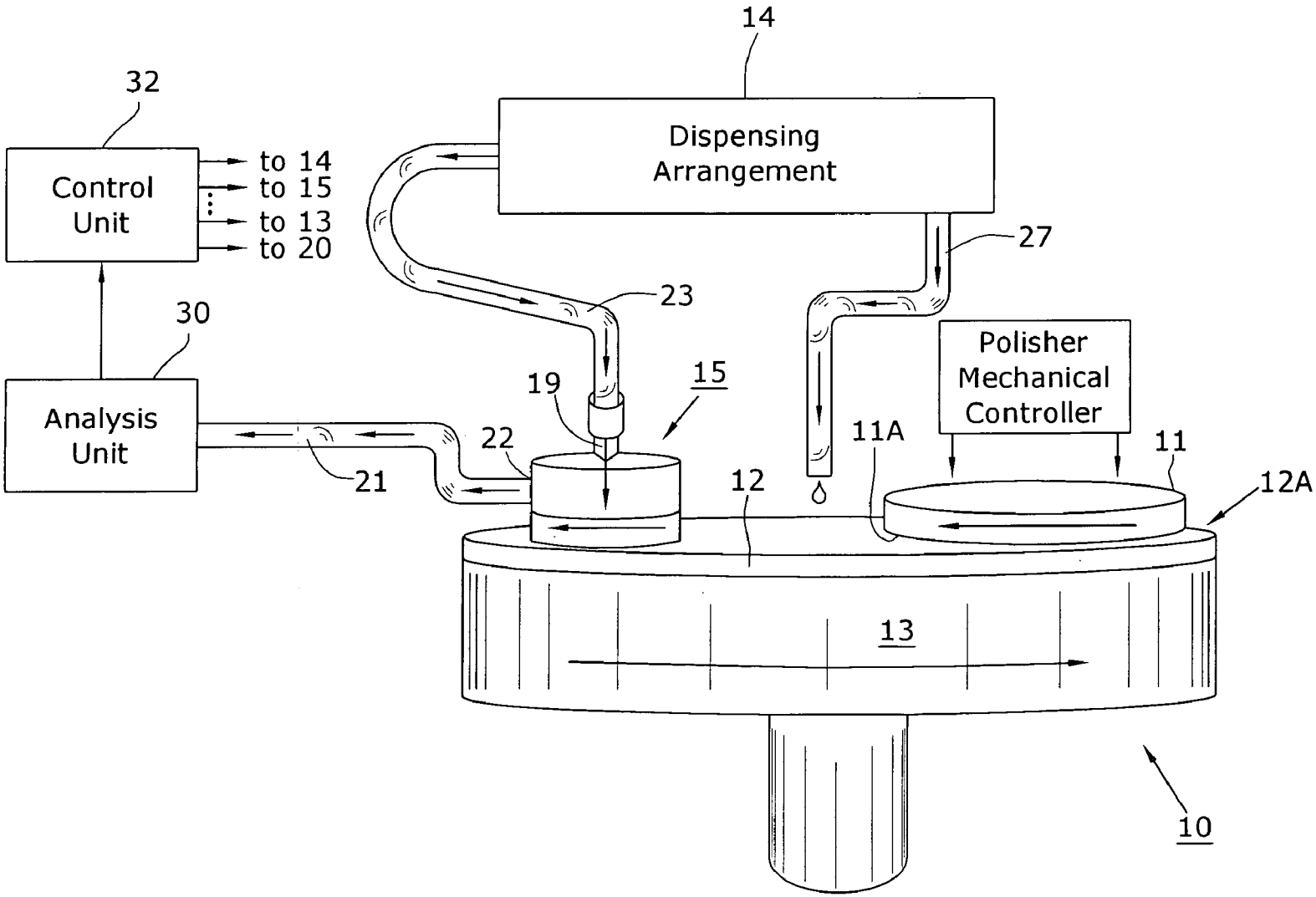
FIG. 1 illustrates an exemplary CMP system including a conditioning apparatus feedback arrangement for controlling a planarization process in accordance with the present invention.

FIG. 1 illustrates an exemplary CMP system 10 that may be used to perform in-situ conditioning and planarization process control in accordance with the present invention. CMP system 10 is shown as comprising a polishing pad 12 that is secured to a platen 13. While platen 13 is illustrated here as being circular, it is to be understood that other systems may use a linear platen, an orbital platen, or any other geometry appropriate for performing the planarization process on a semiconductor wafer surface. A wafer carrier (not shown) is used to secure a wafer-to-be-polished 11 "face down" onto polishing pad 12. A polisher mechanical controller 20 is used to apply a controlled, downward force on wafer 11 to adjust, as necessary, the pressure applied by surface 11A of wafer 11 against surface 12A of polishing pad 12. A polishing slurry from a dispensing arrangement 14 is dispensed onto surface 12A of polishing pad 12.

A conditioning apparatus 15 is used, in accordance with the present invention, to evacuate debris, polishing slurry and conditioning agents (hereinafter referred to as "conditioning process effluent") from polishing pad surface 12A and perform an analysis on at least a portion of the conditioning process effluent to generate a feedback signal that is sent to at least one of dispensing arrangement 14, a polisher mechanical controller 20 and/or conditioning apparatus 15, the feedback signal used to control the planarization process. As described in our co-pending application Ser. No. 10/447,373 filed May 29, 2003 and assigned to the current assignee, a conditioning disk within conditioning apparatus 15 is formed of an abrasive material and contains a number of apertures/openings through the disk. The abrasive material serves to dislodge the debris as it collects on polishing pad surface 12A. Conditioning "agents", such as ultra-pure water (UPW) or other flushing liquids, gasses or other types of solid conditioners (including specifically-chosen chemicals) may be dispensed from dispensing arrangement 14 and through conditioning apparatus 15 onto polishing pad surface 12A to assist in the debris removal process.

Figure 2:
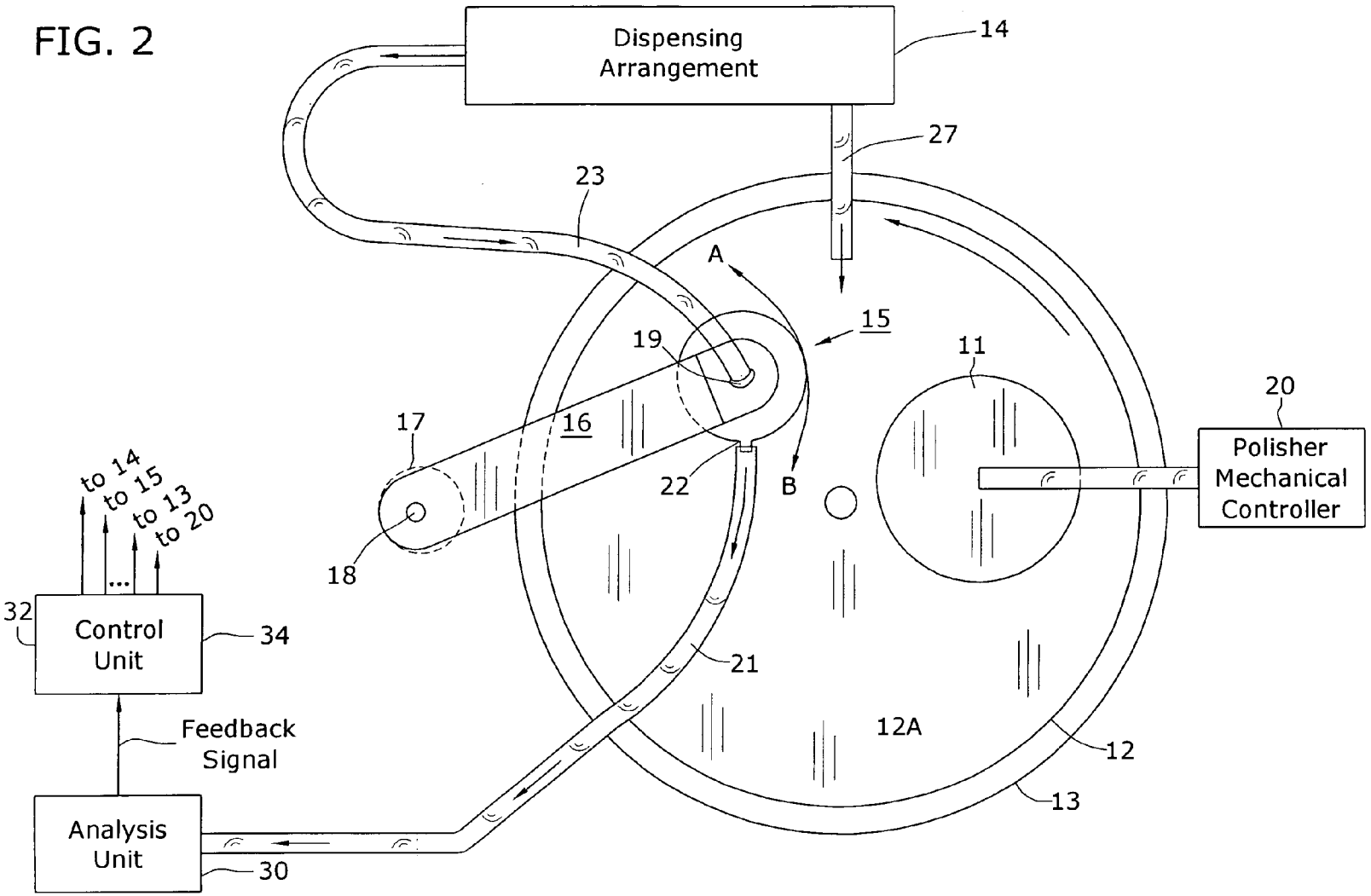
FIG. 2 is a top view of the arrangement of FIG. 1.

Referring to the top view of FIG. 2, the exemplary CMP system 10 is illustrated as utilizing a motorized effector arm 16 to sweep conditioning apparatus 15 across surface 12A of polishing pad 12 so as to dislodge the collected debris, while also imparting a predetermined downward force and rotational movement to the conditioning disk. A motor 17 is used in this particular embodiment to both pivot end effector arm 16 in arc AB (or through any other appropriate translational movement) about a fixed shaft 18, while simultaneously providing rotational motion and applying a downward force to the conditioning disk. Alternatively, a pad conditioner within apparatus 15 may be formed to cover the entire pad radius and not require the use of a motor or the pivoting of an end effector arm to provide across-pad conditioning. As will be discussed below, a "mechanical system" feedback signal from the analysis unit of the present invention may be applied to the various components of conditioning apparatus 15, polisher mechanical controller 20, platen 13 or other elements of CMP system 10 so as to control the applied downward force, rotational movement, translational movement and various other mechanical properties of the polishing and conditioning processes.

A first hose 21 is illustrated in both FIGS. 1 and 2 as attached to a vacuum outlet port 22 on conditioning apparatus 15, such that a vacuum force may be applied through first hose 21 and used to pull the conditioning process effluent from polishing pad surface 12A. A second hose 23, attached to an inlet port 19 of conditioning apparatus 15 is coupled to dispensing arrangement 14 and may be used to dispense flushing liquids, UPW or other conditioning agents onto polishing pad surface 12A. The collected effluent traveling through first hose 21 is then directed into an analysis unit 30, which is used in accordance with the present invention to evaluate predetermined characteristics of the effluent (for example, determining the concentration of one or more elements within the conditioning process effluent). The output from analysis unit 30, in the form of an electrical feedback signal, is then applied as an input to a control unit 32, where control unit 32 generates at least one control signal used to adjust the operation of one or more components of CMP system 10. For example, a first control signal may be sent to dispensing arrangement 14 and used to control the selection of various polishing slurries and/or conditioning agents, control the flow rate of a dispensed material, control the temperature of a dispensed material, etc. A second control signal may be sent to condition apparatus 15 and perhaps applied as an input to motor 17 of conditioning apparatus 15 so as to control mechanical properties of the conditioning process, such as applied downforce, rotational speed of the abrasive disk, translation speed of effector arm 16, etc. Other control signals may be applied to, as mentioned above, platen 13 and/or polisher mechanical controller 20.

In general, feedback signal(s) from the analysis of the conditioning effluent is thus used by control unit 32 to adjust the actual planarization process, by varying one or more chemical parameters associated with the delivery of the polishing slurry and/or conditioning agents to the surface of the polishing pad, and/or varying one or more mechanical parameters such as rotational velocity, pressure applied by the conditioner or wafer, vacuum pull through the conditioning disk, etc. For example, the flow rate of the polishing slurry (or a secondary component, such as an oxidizer) may be modified in response to a control signal. Alternatively (or additionally), the temperature of the slurry may be adjusted, the concentration of the abrasive particulate (and/or the size of the actual particulate material) may be changed, the vacuum pressure applied to conditioning apparatus 15, and/or the downforce applied by wafer 11 against polishing pad 12 may be altered, etc. The temperature of applied conditioning fluids may be modified in response to a signal received by control unit 32 in order to maintain a stable temperature at surface 12A. Alternatively, a control signal associated with the chemistry of the analyzed effluent may be used by control unit 32 and dispensing arrangement 14 to control the application of a neutralizing agent to overcome reactions associated with a prior-applied polishing slurry.

Figure 3:
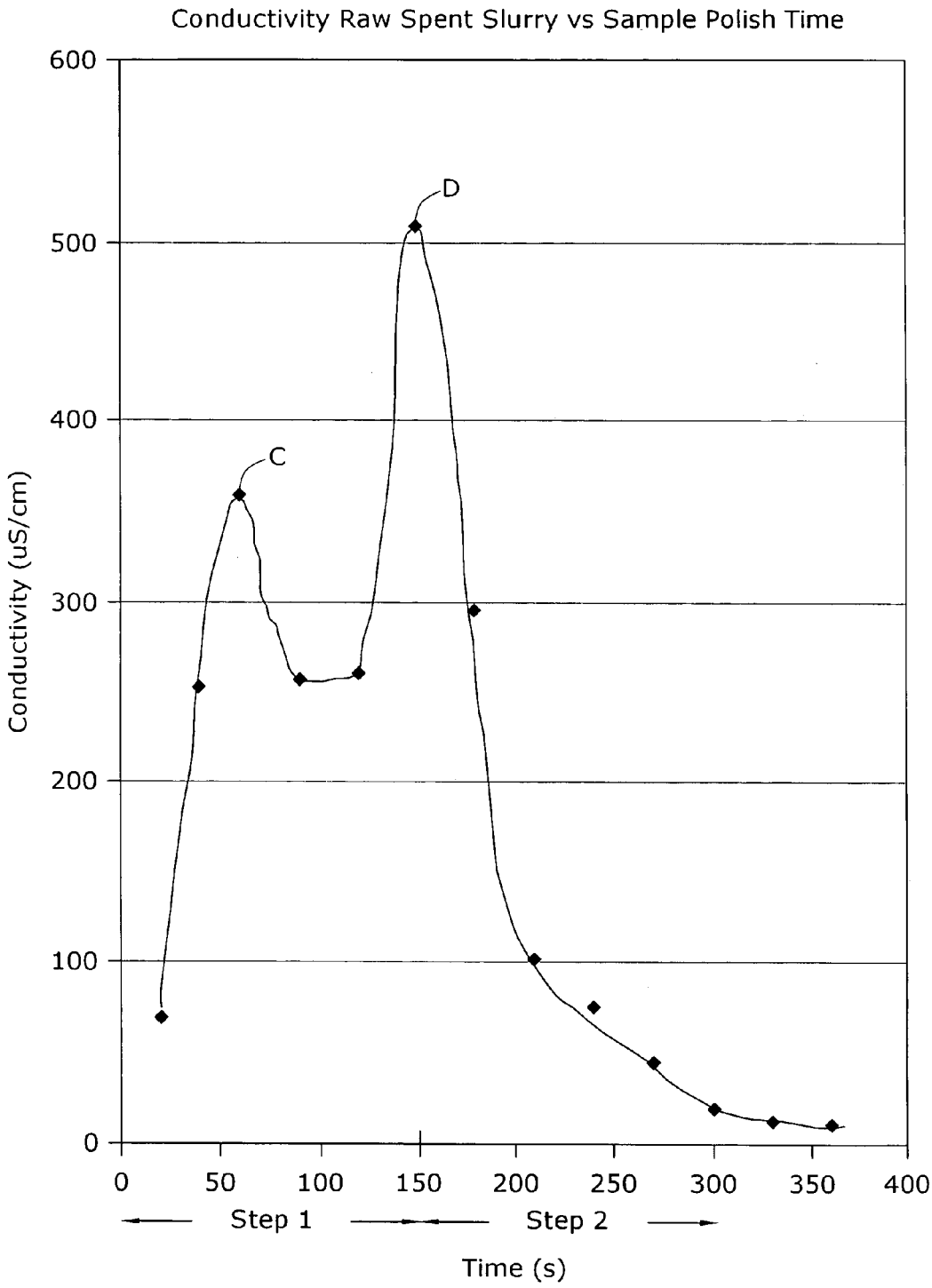
FIG. 3 contains a graph of an exemplary planarization process.

As mentioned above, a significant aspect of the present invention is that the concentration measurement of the conditioning process effluent may be used to perform endpoint detection of the planarization process and actually turn "off" the planarization process. FIG. 3 contains a graph of an exemplary planarization process where the conductivity of the effluent was measured during a copper CMP process to perform endpoint detection. As shown the conductivity has a first peak C (conductivity of approximately 350 μS) after about 60 seconds of wafer polishing. The conductivity of the effluent then drops a bit, then reaches a second peak D (a conductivity of approximately 508 μS) after about 150 seconds of wafer polishing. After this second peak, the conductivity is seen to rapidly fall off, indicating that the overburden copper has been removed—and that the "endpoint" of the copper planarization process has been reached.

As mentioned above, an output signal from control unit 32 may be applied to motor 17 of conditioning apparatus 15 to modify the downforce applied by the conditioning disk against polishing pad surface 12A, as illustrated in FIG. 2. Indeed, this particular control signal may request that the abrasive disk be removed from the conditioning process (i.e., "zero downforce") if the measured conductivity or concentration of an exemplary effluent component were too high. An adjustment system attached to effector arm 16 is considered to provide the desired precise vertical movement of effector arm 16 in the presence of various force considerations. The adjustment system may include a linear actuator in the form of a double-acting cylinder driven by pressure differential in the cylinder chambers. The double-acting feature enables both sides of a piston flange (not shown) to be alternately pressurized and thereafter translated into bi-directional powered motion of end effector 16 in the vertical direction. Control unit 32 may further receive as an input a force signal corresponding to the linear force measured by the adjustment system. Thus, control unit 32 may use, as part of the second control signal transmitted to conditioning apparatus 15, a force adjustment signal to control the conditioning pressure applied by the conditioning disk against pad surface 12A. A separate control signal may used to adjust the position of the double-acting cylinder. Alternatively, the rotational speed of the abrasive disk and/or the translational movement of effector arm 16 may be controlled to either increase or decrease (as desired) the concentration of a particular component within the recovered effluent. Another control signal, applied to platen 13, can be used to control the rotational speed of platen 13 with respect to the wafer being polished. The mechanical aspects of the polishing process itself (e.g., downforce of the wafer against the polishing pad, rotational velocity of the wafer, etc.) may also be controlled via a signal applied to polisher mechanical controller 20.

It is to be understood that these various examples of potential process control for both the planarization process and conditioning process are exemplary only. Any number of process variations may be made by virtue of studying the effluent collected by the conditioning process, in accordance with the teachings of the present invention.

Additionally, there are various arrangements that may be used to implement analysis unit 30. In one case, an arrangement for measuring the pH of the effluent may be used. For example, when performing planarization of a dielectric layer, potassium hydroxide may be used as the chemical additive in the slurry, where the hydroxide will create water as a by-product of the oxidation phase of the planarization process. Inasmuch as the presence of excess water will affect the pH of the effluent, a measurement of the pH can be used to determine the proper amount of consumed hydroxide so as to allow for a controlled, uniform oxidation-reduction during planarization of the dielectric layer on the wafer. Alternatively, the oxidation potential of the conditioning process effluent may be measured and used to generate a feedback signal. In a further example, particle size within the effluent may be measured and used to generate a feedback signal to adjust the vacuum force or pressure being applied by conditioning apparatus 15.

When using the inventive CMP control process in a metal CMP system (for example), an electrochemical analyzer may be used as analysis unit 30. An electrochemical analyzer functions to distinguish metal ions of interest from the remaining elements in the effluent, according to a predetermined reduction-oxidation potential, then quantifies the redox potential and metal ion concentration based on predetermined calibration curves. In particular, as the planarization process begins, the amount of metal ions in the effluent will rapidly increase, then reach a plateau value. During a subsequent "soft landing" polishing step (designed to remove the last vestiges of the unwanted metal), the concentration of metal ions in the effluent will be reduced by at least an order of magnitude. At the point where the unwanted metal has been completely removed from the wafer surface, the concentration will again rapidly decrease. Thus, by being able to measure when these changes in concentration occur, the arrangement of the present invention can accurately determine the "endpoint" of the planarization process. An appropriate feedback signal from analysis unit 30 can then be applied to control unit 32 and used to generate a "halt" signal to stop the planarization process and lessen the chance of over-polishing and dishing into the wafer surface. This "halt" control signal may be applied, for example, to dispensing arrangement 14, polisher mechanical controller 20, or both.

In the case where the surface layer of the semiconductor wafer contains more than one material (such as, for example, an interconnect metal (e.g., copper) and a barrier metal (e.g., tantalum)), a particular embodiment of the present invention can be used to provide control and monitoring of the planarization of each of these materials. In particular, a Raman spectrometer can be used as analysis unit 30 to ascertain the concentration of each material in the effluent. During the planarization process, the relative concentrations of the two metals will change as a function of time. For example, at the beginning of the process, a large amount of copper will begin to be removed from the wafer surface, with virtually no tantalum being present in the wafer debris. Thus, the concentration of copper in the evacuated effluent will be relatively high, with essentially no tantalum being detected. As the process continues, the tantalum will begin to be exposed and the relative concentrations of copper and tantalum in the collected effluent will change accordingly. The feedback output from the Raman spectrometer can then be used by control unit 32 to generate control signals for performing system adjustments, such as adjusting the down pressure applied by the wafer against the polishing pad, or alternatively, changing the chemistry of the slurry once the copper has been removed, modifying the polishing slurry flow rate, temperature, abrasive particulate morphology, etc., as discussed above. Alternatively, the conductivity of the collected effluent may be measured and used as a feedback signal. In any case, by virtue of the collection of effluent occurring in real time (and before it enters the common waste stream), the concentration of various materials in the effluent remain relatively high (on the order of 20–80 times greater than if allowed to combine with the remainder of the waste stream). This higher concentration allows for a more precise analysis of the debris, with a much-improved signal-to-noise ratio over other waste analysis systems of the prior art.

While the foregoing description of the implementation of a control path based on collected conditioning process effluent has been described in terms of preferred embodiments, it is to be understood that there exist various modifications that may be made by those skilled in the art that will fall within the scope of the present invention. For example, various other techniques may be used to analyze the conditioning process effluent and control the planarization process. The control signal may also be used as a feedback to the conditioning process itself, modifying parameters such as conditioning agents, vacuum force, abrasive conditioning disk down force, etc. All of these variations are considered to be within the realm of one skilled in the art and the subject matter of the present invention will be limited only by the scope of the claims appended hereto.

What is claimed is:

1. An arrangement for providing control and monitoring of the process of planarizing a semiconductor wafer in a chemical mechanical planarization (CMP) system, the arrangement comprising:

conditioning apparatus including an inlet port, an outlet port, and an abrasive conditioning disk for dispensing conditioning agents and dislodging spent polishing slurry, wafer debris and/or conditioning agents (collectively, "effluent") from the surface of a CMP polishing pad, the conditioning apparatus further including a vacuum outlet path coupled to the outlet port for evacuating the effluent from the vicinity of the polishing pad;

an analysis unit, coupled to the vacuum outlet path, for collecting at least a portion of the effluent evacuated from the polishing pad surface during a conditioning operation, the analysis unit for evaluating at least one component in the received portion of the effluent attributed to changes at the wafer surface and generating therefrom a control signal for fine-tuning the on-going process of planarizing a semiconductor wafer; and a polishing slurry delivery apparatus separate from the conditioning apparatus for dispensing at least one polishing slurry onto the surface of the polishing pad during an on-going process of planarizing a semiconductor wafer, the polishing slurry delivery apparatus responsive to the control signal generated by the analysis unit to adapt the on-going process of planarizing a semiconductor wafer in response to the evaluated changes at the wafer surface.

2. An arrangement as defined in claim 1 wherein the analysis unit is a chemical analysis unit for evaluating the chemistry of one or more effluent components and generating a control signal therefrom for fine-tuning the on-going process of planarizing a semiconductor wafer.

3. An arrangement as defined in claim 1 wherein the conditioning agents include ultra-pure water to flush spent polishing slurry and wafer debris from the surface of the CMP polishing pad.

4. An arrangement asdefined in claim 1 wherein the conditioning agents include a chemical additive to neutralize chemical by-products of the planarization process.

5. An arrangement as defined in claim 1 wherein the conditioning agents include chemical additives that function as complexing agents to react with the effluent.

6. An arrangement as defined in claim 1 wherein the analysis unit comprises a Raman spectrometer for measuring the relative concentrations of various elements within the effluent and providing the control signal based on the measured relative concentrations.

7. An arrangement as defined in claim 1 wherein the analysis unit generates a chemical process control signal for modifying one or more parameters associated with the chemistry of the on-going process of planarizing a semiconductor wafer.

8. An arrangement as defined in claim 7 wherein the chemical process control signal from the analysis unit is used to modify at least one parameter selected from the group consisting of: polishing slurry flow rate, polishing slurry temperature, polishing slurry concentration, particulate size particulate concentration and polishing slurry chemistry.

9. An arrangement as defined in claim 1 wherein the CMP system utilizes the control signal from the analysis unit to determine the end point of the process of planarizing the semiconductor wafer.

10. A method of monitoring and controlling the process of planarizing a semiconductor wafer in a chemical mechanical planarization (CMP) system, the method comprising the steps of:

a) applying an abrasive conditioning disk to a polishing pad surface during a planarization operation to dislodge debris from said surface;

b) evacuating spent polishing slurry, wafer debris and/or conditioning agents (collectively, "effluent") through a vacuum-assisted conditioning apparatus;

c) collecting at least a portion of evacuated effluent for analysis of an on-going planarization process;

d) evaluating at least one characteristic of the collected effluent, said at least one characteristic attributed to changes at the wafer surface being planarized;

e) generating a control signal based on the evaluated effluent characteristic ; and f) providing the control signal as an input to a polishing apparatus to fine-tune the on-going planarization process in response to the evaluated changes at the wafer surface.

11. The method as defined in claim 10 wherein the control signal generated in step e) is a "chemical" control signal associated with a change in at least one chemical aspect of the on-going process of planarizing a semiconductor wafer.

12. The method as defined in claim 11 wherein the chemical control signal is used to control at least one planarization parameter selected from the group consisting of: polishing slurry flow rate, polishing slurry temperature, polishing slurry concentration, particulate size, particulate concentration and polishing slurry chemistry, chemistry of applied conditioning agents, and temperature of applied conditioning agents.

13. The method as defined in claim 11 wherein the provided control signal is used to detect an end point of the process of planarizing the semiconductor wafer.

14. A method of controlling and monitoring the polishing and/or conditioning processes of planarizing a semiconductor wafer in a chemical mechanical planarization (CMP) system, the method comprising the steps of:

a) applying an abrasive conditioning disk to a polishing pad surface during a planarization operation to dislodge debris from said surface;

b) evacuating spent polishing slurry, wafer debris and/or conditioning agents (collectively, "effluent") through a vacuum outlet oath coupled to an outlet port in the conditioning apparatus;

c) collecting at least a portion of evacuated effluent in an analysis unit coupled to the vacuum outlet path;

d) evaluating at least one characteristic of at least one element within the collected, evacuated effluent;

e) generating a control signal for fine-tuning the process of planarizing a semiconductor wafer based on the evaluated effluent characteristics; and f) providing the control signal as an input to a polishing apparatus to control the on-going process of planarizing the semiconductor wafer.

* * * * *